US006712162B2

(12) United States Patent
Britz

(10) Patent No.: US 6,712,162 B2
(45) Date of Patent: Mar. 30, 2004

(54) COOLING AND FLUSHING MEANS FOR TOOLS USED FOR WORKING ROCK

(75) Inventor: Rory Britz, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 157 days.

(21) Appl. No.: 09/942,379

(22) Filed: Aug. 29, 2001

(65) Prior Publication Data

US 2002/0027023 A1 Mar. 7, 2002

(30) Foreign Application Priority Data

Sep. 4, 2000 (DE) ..... 100 43 418

(51) Int. Cl.[7] ..... E21B 21/00
(52) U.S. Cl. ..... 175/210; 175/217
(58) Field of Search ..... 175/84, 210, 213, 175/217, 206, 207

(56) References Cited

U.S. PATENT DOCUMENTS 2,786,652 A * 3/1957 Wells ..... 175/25
2,941,783 A * 6/1960 Stinson ..... 175/206
5,497,839 A * 3/1996 Moir ..... 175/65
5,725,021 A * 3/1998 Dallas ..... 137/563

* cited by examiner

*Primary Examiner*—David Bagnell
*Assistant Examiner*—Jennifer R Dougherty
(74) *Attorney, Agent, or Firm*—Sidley Austin Brown & Wood, LLP

(57) ABSTRACT

A cooling and flushing arrangement (1) for a tool (10), has a coolant and flushing agent (2) in a closed storage tank (3), which is connected to a suction pump (4) and has a closed flushing circulation system (6) running from the storage tank (3) through a filter (8), connected via a pressure pump (7) and through a collecting member (11) associated with the tool (10), with a suction line (12) running back to the storage tank (3). A reservoir circulation system (13) for the coolant and flushing agent (2), contains a reservoir (14) connected to the storage tank (3) via a float valve (15) situated in the storage tank (3), and is connected at another location in the flushing circulation system (6) to the reservoir (14) via a valve (16).

11 Claims, 3 Drawing Sheets

COOLING AND FLUSHING MEANS FOR TOOLS USED FOR WORKING ROCK

BACKGROUND OF THE INVENTION

The invention is directed to a cooling and flushing arrangement for tools used for working rock, preferably for annular core bits used in diamond core drills for masonry, concrete and rock.

In the case of cooling and flushing arrangements for tools or tool devices in general, a fluid coolant and flushing agent, such as water, is conveyed by means of a pump at least over parts of the tool in a closed flushing circulation system including a storage tank.

According to EP 36,814, the cooling and flushing arrangement for a tool in the form of a rock saw having a rock saw blade cooled by a coolant and flushing agent comprises a storage tank and a reservoir that are connected via a float valve for automatically refilling the storage tank. This cooling and flushing arrangement without a pump does not form a closed flushing circulation system and, therefore, at least discontinuously, requires filling with coolant and flushing agent.

According to U.S. Pat. No. 3,782,501, the cooling and flushing arrangement for a tool device has a float valve located inside a storage tank and that, for a control circuit, determines the flow of coolant and lubricant in a closed circulation system having a reservoir, a pump and a filter and, depending on the flow, blocks the tool device.

According to EP 0,941,828, a cooling and flushing arrangement for annular core bits used in diamond core drills has a storage tank with a suction pump and a filter connected via a pressure pump in a closed flushing circulation system. The storage tank, which has to accommodate the entire quantity of coolant and flushing agent, cannot be situated near the tool in all application cases because of its volume and weight whenever large amounts of coolant and flushing agent are needed.

SUMMARY OF THE INVENTION

The objective of the invention is to provide a cooling and flushing arrangement for tools used for working rock, whose storage tank can be situated near the tool, even when large amounts of coolant and flushing agent are needed.

The cooling and flushing arrangement has a coolant and flushing agent in a closed storage tank, which is connected to the ambient atmosphere via a suction pump for generating a negative pressure, and the arrangement has a closed flushing circulation system running from the storage tank through a filter, which is connected via a pressure pump for generating the flushing circulation in order to clean the coolant and flushing agent, and through a collecting member associated with the tool for collecting the dirty coolant and flushing agent flowing back from the tool in a suction line, back to the storage tank. Essentially, this flushing circulation system is combined with a reservoir circulation system in which coolant and flushing agent—conveyed by the suction pump connected to the storage tank and by the negative pressure for drawing in the coolant and flushing agent that is generated by the flow resistance in the flushing circulation system via the collecting member and via the suction line—is drawn in from an open reservoir into the storage tank, when a float valve situated in the storage tank for regulating the filling level is open. The coolant and flushing agent of the reservoir circulation system moves, together with the coolant and flushing agent of the flushing circulation system, through the pressure pump into the filter and flows back into the reservoir via a filter concentrate drain at the lower end of the filter as dirty coolant and flushing agent.

When the float valve is completely open, the inflow from the reservoir predominates over the outflow into the reservoir, thus compensating for a shortage of coolant and flushing agent in the flushing circulation system. When the float valve is closed, the outflow into the reservoir predominates over the inflow from the reservoir, thus removing excess coolant and flushing agent from the flushing circulation system. Because of the combined reservoir circulation system, the storage tank can be configured very small and thus can be situated near the tool, as a result of which the drawing in of the coolant and flushing agent via the collecting member can be improved or, with the same storage tank, larger amounts of coolant and flushing agent can be used.

Advantageously, a tool device to be cooled is integrated into the flushing circulation system between the filter and the tool.

Preferably, the suction pump and the pressure pump are combined by a shared drive which is also advantageously combined with the drive of the tool device.

Advantageously, the tool device comprises the storage tank and the reservoir, whereby also advantageously, the tool device is formed as a core drill.

Advantageously, the storage tank is configured so as to float on the coolant and flushing agent of the reservoir, as a result of which only a very small negative pressure is needed to pump the reservoir circulation system.

Preferably, the collecting member is shaped as a torus that holds an annular core bit coaxially on the inside so as to seal it radially. It is axially open on one end opposite the radial seal and affords an axial seal at the open end against a surface to be worked and the torus has a connection for a suction line.

Preferably, water is the coolant and flushing agent, combining a high thermal capacity and cleaning power with biological safety and extremely high availability.

BRIEF DESCRIPTION OF THE INVENTION

The invention is explained in greater depth with reference to an advantageous embodiment, and:

DETAILED DESCRIPTION OF THE INVENTION

Figure 1:
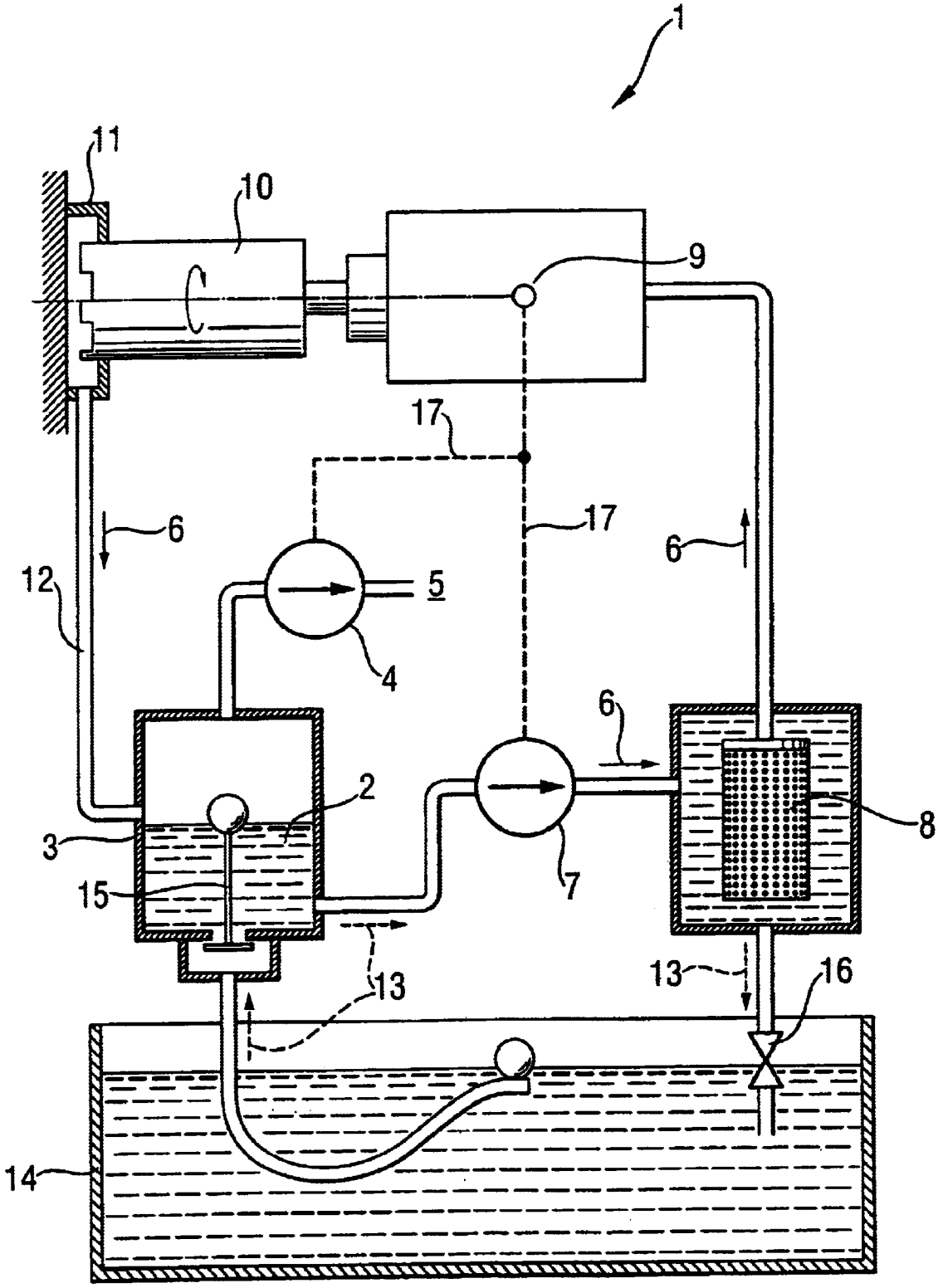
FIG. 1 is a schematic showing of a cooling and flushing arrangement.

According to FIG. 1, a cooling and flushing arrangement 1 has a coolant and flushing agent 2 in the form of water in a closed storage tank 3, which is connected to the ambient atmosphere 5 via a suction pump 4, and has a closed flushing circulation system 6 running from the storage tank 3 through a pressure pump 7, then through a filter 8, to a tool device 9 in the form of a core drill, then over parts of a tool 10 in the form of an annular core bit and finally through a collecting member 11 associated with the tool 10, and over a suction line 12 back to the storage tank 3. The flushing circulation system 6 is combined with a reservoir circulation system 13 in which the coolant and flushing agent 2 moves from a large reservoir 14, open to the ambient atmosphere 5, via a float valve 15 situated in the storage tank 3 and controlled by the filling level, into the storage tank 3, then together with the flushing circulation system 6, through the pressure pump 7 into the filter 8 and via a filter concentrate drain or valve 16 at the lower end of the filter 8 as dirty coolant and flushing agent flows back into the reservoir 14. The suction pump 4 and the pressure pump 7 are combined with the tool device 9 via a shared drive 17.

Figure 2:
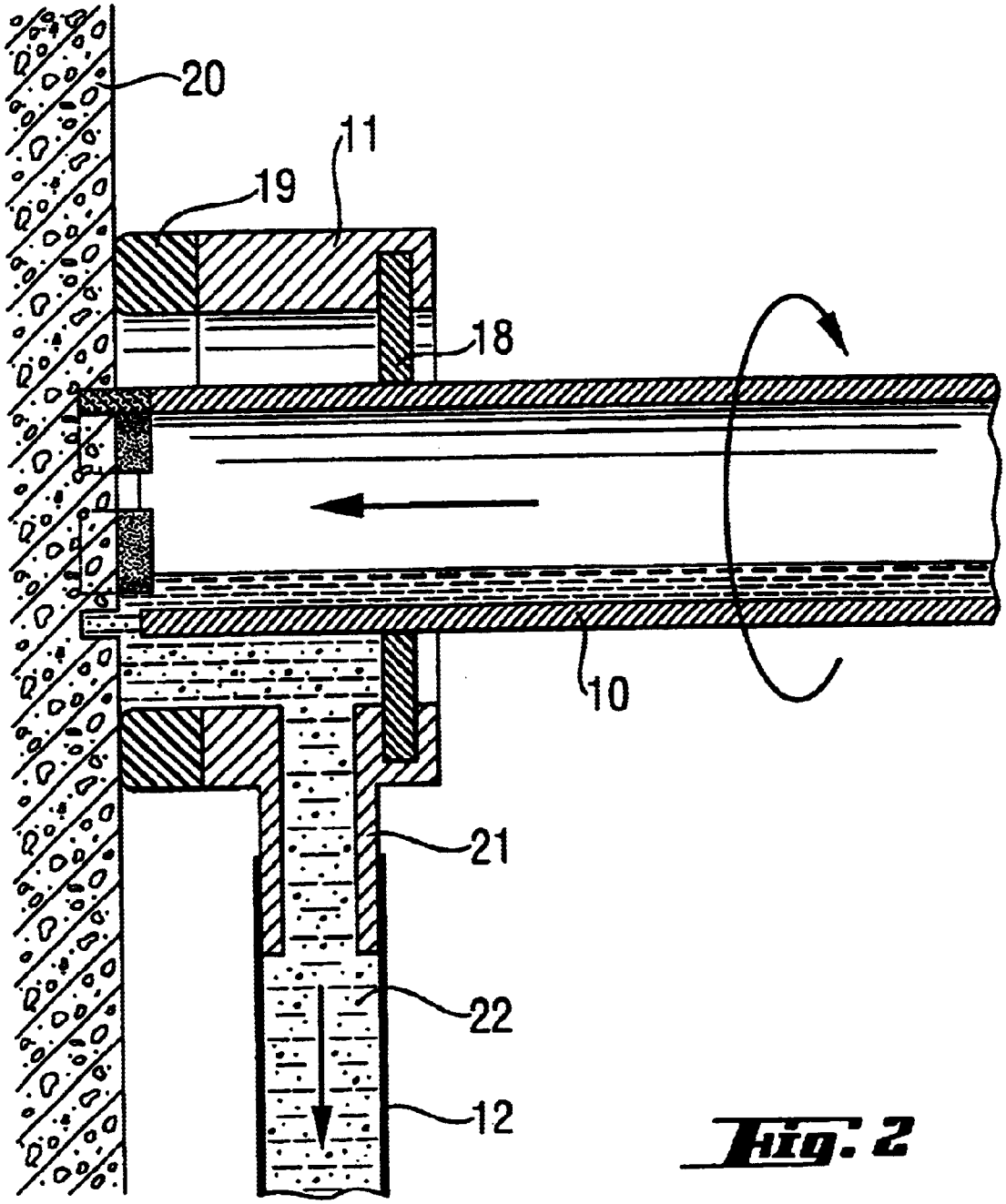
FIG. 2 is a schematic showing of a collecting device.
Figure 3:
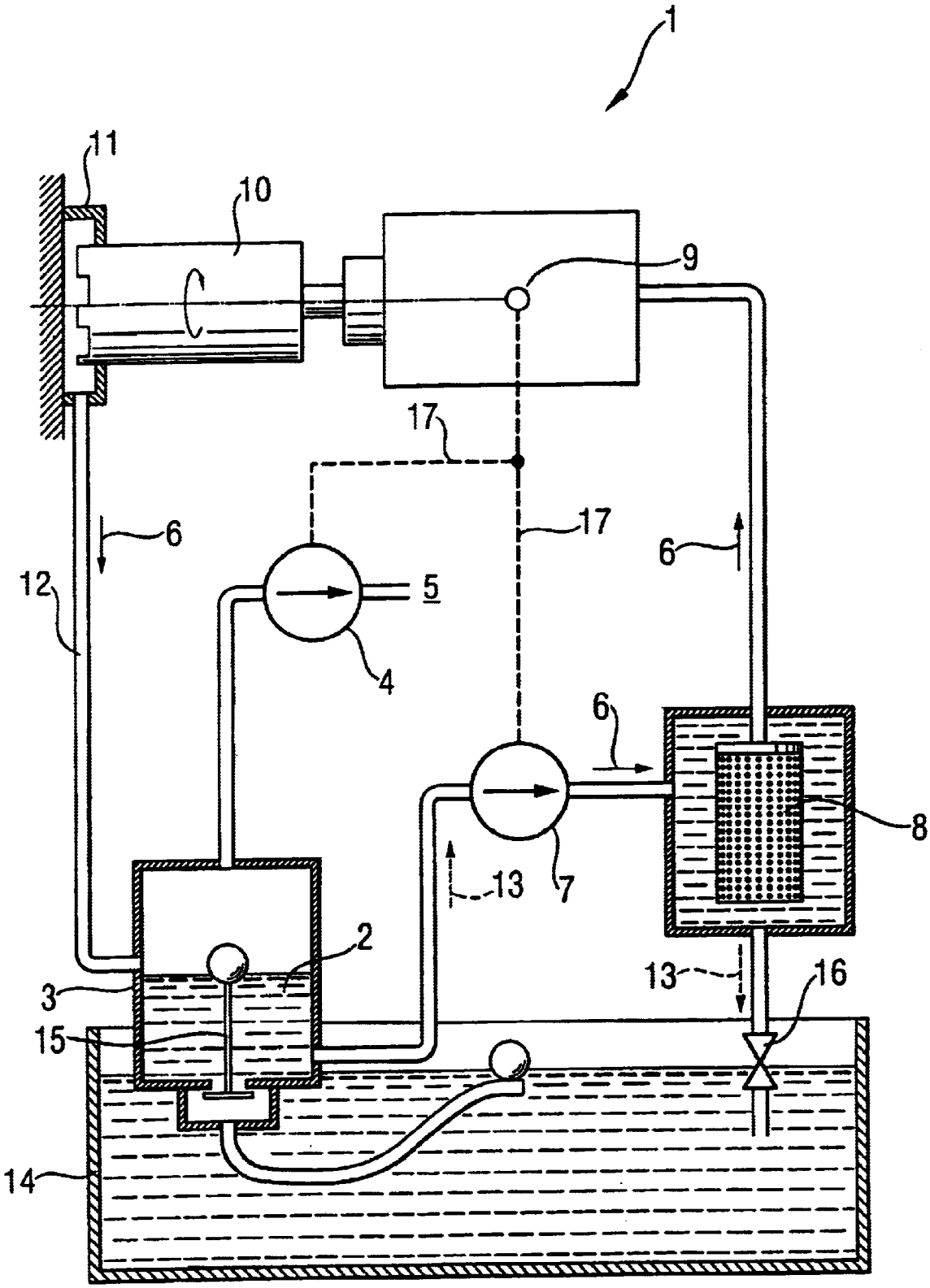
FIG. 3 is a schematic showing, similar to FIG. 1. however, with the storage tank in a floating position.

According to FIG. 2, the collecting member 11 is formed as a torus that holds an annular core bit of the tool 10 coaxially on the inside with radial gaskets 18 so as to seal radially one end of the collecting member 11, which is axially open on the other end and is sealed, axially by axial gaskets 19 against a surface 20 to be worked, and that has a connection 21 for the suction line 12 through which the coolant and flushing agent 2, that has become contaminated with removed material 22, is discharged.

What is claimed is:

1. A cooling and flushing arrangement for a tool (10) including a coolant and flushing agent (2) contained in a closed storage tank (3), a suction pump (4) connected to said storage tank (3), a closed flushing circulation system (6) extending in a supply line from said storage tank (3) through a filter (8) with a pressure pump (7) located in the pipeline between said storage tank (3) and said filter (8), said supply line extending from said filter (8) to a collecting member (11) enclosing at least a part of said tool (10), said flushing circulation system (6) including a suction line (12) extending from said collecting member (11) to said storage tank (3), said flushing circulation system (6) is combined with a reservoir circulation system (13) for said coolant and flushing agent (2) comprising a reservoir (14) connected to said storage tank (3) via a float valve located in said storage tank (3) and said reservoir (14) connected at a position spaced from the connection to said storage tank (3) to said flushing circulation system (6) via a drain valve (16), said drain valve (16) forms a filter concentrate drain at a lower end of said filter (8).

2. A cooling and flushing arrangement, as set forth in claim 1, wherein said suction pump (4) is connected to the ambient atmosphere, and said reservoir (14) is also open to the ambient atmosphere.

3. A cooling and flushing arrangement, as set forth in claim 1, wherein a tool assembly (9) containing said tool (10) forms a part of said flushing circulation system (6) and is located between said filter (8) and said tool (10).

4. A cooling and flushing arrangement, as set forth in claim 3, wherein said tool assembly is connected to said storage tank (3) and to said reservoir (14).

5. A cooling and flushing arrangement, as set forth in claim 3, wherein said tool assembly (9) comprises a core drill and said tool (10) is an annular core bit.

6. A cooling and flushing arrangement, as set forth in claim 1, wherein a drive (17) forms the driving means for said suction pump (4) said pressure pump (7) and said tool assembly (9).

7. A cooling and flushing arrangement, as set forth in claim 1, wherein a tool assembly (9) is connected to said storage tank (3).

8. A cooling and flushing arrangement, as set forth in claim 1, wherein said storage tank (3) is arranged to float on said coolant and flushing agent (2) in said reservoir (14).

9. A cooling and flushing arrangement, as set forth in claim 1, wherein said collecting member (11) comprising an axially elongated torus holding said tool (10) coaxially therein, said torus having a first end closer to said collecting member (11) and a second end more remote from said collecting member (11), a radial seal (18) extending radially between said torus and said tool (10) at said second end, a axial seal (19) between said first end and a surface to be worked on by said tool (10), and a connection (21) in said collecting member (11) for said suction line (12).

10. A cooling and flushing arrangement, as set forth in claim 1, wherein said cooling and flushing agent (2) is water.

11. A cooling and flushing arrangement, for a tool (10) including a coolant and flushing agent (2) contained in a closed storage tank (3), a suction pump (4) connected to said storage tank (3), a closed flushing circulation system (6) extending in a supply line from said storage tank (3) through a filter (8) with a pressure pump (7) located in the pipeline between said storage tank (3) and said filter (8), said supply line extending from said filter (8) to a collecting member (11) enclosing at least a part of said tool (10), said flushing circulation system (6) including a suction line (12) extending from said collecting member (11) to said storage tank (3), said flushing circulation system (6) is combined with a reservoir circulation system (13) for said coolant and flushing agent (2) comprising a reservoir (14) connected to said storage tank (3) via a float valve located in said storage tank (3) and said reservoir (14) connected at a position spaced from the connection to said storage tank (3) to said flushing circulation system (6) via a drain valve (16), a drive (17) forms the driving means for said suction pump (4) and said pressure pump (7).

* * * * *